US005295931A

United States Patent [19]

Dreibelbis et al.

[11] Patent Number: 5,295,931

[45] Date of Patent: Mar. 22, 1994

[54] ROWING MACHINE EXERCISE APPARATUS

[75] Inventors: John S. Dreibelbis, Shakopee; Charles C. Hall, St. Louis Park; Dale R. Henn, Minneapolis; Pat J. Novak, St. Paul, all of Minn.

[73] Assignee: NordicTrack, Inc., Chaska, Minn.

[21] Appl. No.: 941,181

[22] Filed: Sep. 4, 1992

[51] Int. Cl.[5] ..... A63B 69/06

[52] U.S. Cl. ..... 482/72; 482/125

[58] Field of Search ..... 482/72, 73, 148, 121-122, 482/123, 125, 129, 133

[56] References Cited

U.S. PATENT DOCUMENTS

| | | | |
|---|---|---|---|
| 1,577,809 | 3/1926 | Randall | 482/72 |
| 1,750,549 | 3/1930 | Thomson et al. | 482/72 |
| 1,866,860 | 7/1932 | Pareira . | |
| 1,905,092 | 4/1933 | Hardy | 482/72 |
| 1,982,872 | 12/1934 | Husted | 272/72 |
| 1,994,593 | 3/1935 | Schmidt | 272/72 |
| 3,261,606 | 7/1966 | Elia et al. | 482/72 |
| 3,394,934 | 7/1968 | Elia et al. | 272/72 |
| 4,421,307 | 12/1983 | Cunnington et al. | 272/72 |
| 4,706,953 | 11/1987 | Graham | 272/120 |
| 4,795,147 | 1/1989 | Seal | 272/130 |
| 5,072,929 | 12/1991 | Peterson et al. | 482/72 |

*Primary Examiner*—Stephen R. Crow

[57] ABSTRACT

The present invention provides an exercise apparatus having a frame that extends between a front end and a rear end, and is designed to rest upon a floor surface. The frame supports an inclined rail at an angle of greater than five degrees relative to the floor surface. A seat is slidably secured relative to the rail, and the angle of inclination opposes rearward movement of the seat. A load resistant line means is secured at one end to the seat and at another effective end relative to the frame to further oppose rearward movement of the seat.

4 Claims, 6 Drawing Sheets

ROWING MACHINE EXERCISE APPARATUS

FIELD OF THE INVENTION

The present invention relates generally to exercise equipment and more particularly, to an improved rowing machine exercise apparatus.

BACKGROUND OF THE INVENTION

More and more people are recognizing the benefits of regular exercise, and the exercise industry has experienced rapid growth as a result. Popularity has sparked demand for exercise equipment and translated into greater sophistication, increasing the need for new and improved exercise equipment. One popular form of exercise is simulated rowing, which has prompted the development of various rowing machine exercise devices that are discussed in general terms below.

The rowing stroke basically consists of a "drive" portion in which the rower thrusts backward, a "recovery" portion in which the rower leans forward, and a "catch" portion in which the rower makes the transition from the recovery portion to the next drive portion. To simulate this rowing motion, a typical rowing machine has a seat that slides back and forth on a rail or track. During the drive portion of the motion, a person sitting in the seat pushes against a platform to force the seat rearward, while also pulling rearward on some type of handle. During the recovery portion of the motion, the seat and handle return forward to stable rest positions. During the catch portion of the motion, the rower recovers the resistance, if any, to rearward movement of the seat and/or handle.

One problem with conventional prior art rowing machines is that the primary resistance to movement is provided through the handle, so that the focus of the rowing exercise is the arms rather than the legs. As a result, the rowing exercise is more stressful on the person's back, as force is transmitted from the person's arms down through the back to the seat. Also, the rowing exercise tends to be less productive because the back stress tends to fatigue a person prematurely, prior to achieving worthwhile aerobic exercise. Additionally, the rowing exercise would likely burn more calories if a significant portion of the workout were imposed on the leg and hip muscles, which are larger and can do more work than the arm muscle. Thus, it is desirable to provide a rowing machine exercise apparatus that provides direct resistance to rearward movement of the seat in order to more significantly involve the muscles of the legs and hips. Some prior art devices have addressed this concern, but it remains a significant design consideration nonetheless.

Another common problem with rowing machines is that the seat and the foot platform are at the same relative elevation above the ground. As a result, a person using a "flat" rowing machine typically must crouch forward into a cramped position in order to reach the handle, and often also tends to lean backward during the drive motion. Such deviations from a proper posture place unnecessary stress on the person's back, creating a greater risk of injury (such as hyperextension of the lower back) and reducing the effectiveness of the exercise. The premature fatigue problems are exacerbated with this type of machine because the exercise focuses away from the upper legs and hips. Thus, it is desirable to provide a rowing machine exercise apparatus that makes it unnecessary and undesirable to assume a less than ideal posture during rowing exercise. The potential for injury increases as a person leans further backward during the drive portion of each rowing stroke. As a person approaches a supine position parallel to the ground, the person's spine assumes an orientation perpendicular to the direction of gravitational force so that a maximum stress must be placed on the person's back in order to return to an upright position. Thus, it is desirable to provide a rowing machine that eliminates the possibility of the person assuming a supine position parallel to the ground.

Most "flat" rowing machines are also relatively difficult to mount and dismount due to their proximity to the ground. In many instances, the seat is only inches from the floor surface supporting the rowing machine. In order to minimize the potential for back injury, it is desirable to provide a rowing machine exercise apparatus that has a seat positioned at a more suitable level above the ground to facilitate mounting and dismounting.

Yet another problem with typical rowing machines is the absence of any selective limit on the attainable range of motion. A person undergoing rehabilitation or susceptible to back injury may face injury by moving too far forward during the recovery portion of a stroke. Thus, it is desirable to provide a rowing machine that includes a mechanism for limiting the travel of the seat according to specific needs.

Many rowing machines also suffer from relatively complicated and expensive construction that renders such machines an unaffordable luxury for the average consumer. An additional problem with many such machines is that they are not designed to be portable. Thus it is desirable to provide a rower that is relatively simple and lightweight in construction.

Inadequacies also exist with respect to many of the various resistance systems incorporated into rowing machines. For example, the resistance can often be disjointed, difficult to equate for each arm, and/or susceptible to slippage. Also, many of the rowing machines are severely limited in terms of resistance adjustability.

SUMMARY OF THE INVENTION

According to one embodiment, the present invention provides an exercise apparatus having a frame that extends between a front end and a rear end and is designed to rest upon a floor surface. An inclined rail is supported by the frame in such a manner that the inclined rail defines an angle of greater than five degrees relative to the floor surface. A seat is slidably secured relative to the rail, and the angle of the inclined rail opposes rearward movement of the seat. A load resistant line means is secured at one end to the seat and at another effective end relative to the frame, to further oppose rearward movement of the seat. Also, a foot rest is mounted on the frame proximate the front end.

According to another embodiment, the present invention provides a rowing exercise apparatus having a frame that extends from a front end to a rear end and is designed to rest upon a floor surface. The frame supports a rail above the floor surface in such a manner that the rail is inclined downward from the rear end to the front end. A seat is slidably secured relative to the rail, and a foot rest is secured relative to the frame proximate the front end. A first elastic cord extends forward from the seat, onto a first pulley on the frame proximate the front end, and then rearward to a first retaining means on the frame proximate the rear end. A bar is movably secured relative to the frame proximate the front end, and the bar extends perpendicular relative to the rail and parallel relative to the floor surface. A second elastic cord extends forward from the bar, onto an elevated pulley on the frame proximate the front end, downward and onto a second pulley on the frame proximate the front end, and then rearward to a second retaining means on the frame proximate the rear end.

In a preferred embodiment, the rail is inclined at an angle of approximately fourteen degrees relative to the floor surface. A stop is releasably secured to the rail, extending upward to prevent the seat from sliding forward beyond the stop. The first elastic cord engages a first intermediate pulley on the frame between the seat and the first pulley. The first elastic cord also engages a second intermediate pulley on the frame between the first pulley and the first retaining means, which takes the form of a nip arrangement. The second elastic cord engages a third intermediate pulley on the frame between the second pulley and the second retaining means, which also takes the form of a nip arrangement. The intermediate pulleys share a common axis. The first and second elastic cords are integral portions of a single bungee cord. Also, the bar is movably secured relative to a forward upright on the frame at an elevation above the floor surface higher than any portion of the rail, and the foot rest is pivotally mounted to the frame just beneath the upright.

The present invention also provides a method of providing resistance to exercise movement on a rowing simulator using a single elastic cord. A first end of the elastic cord is secured to a simulator rowing bar. A first intermediate portion of the elastic cord is routed over at least two pulleys and through a first nip arrangement. As a result, a first intermediate length of the elastic cord is anchored between the simulator rowing bar and the first nip arrangement. A second intermediate portion of the elastic cord is routed through a second nip arrangement and over at least one pulley, such that a slack portion of the elastic cord is caught between the first nip arrangement and the second nip arrangement. The second intermediate portion terminates in a second end of the elastic cord, which is secured to a seat to anchor a second intermediate length of the elastic cord between the second nip arrangement and the seat. The intermediate lengths of elastic cord may be adjusted by adding to or removing from the slack portion between the nip arrangements.

The inclined rail provides resistance to movement of the seat as a function of a person's weight, yet the selective use of the stop provides an element of safety as the need arises. The inclined rail also reduces stress on a person's back by encouraging proper posture and further, by eliminating the possibility of approaching a supine position relative to the floor surface. Additionally, the inclined rail supports the seat at a reasonable distance above the ground for purposes of safely mounting and dismounting the apparatus.

The elastic cord provides additional smooth resistance that allows for infinite adjustability through a practical range of resistance, and also provides resistance that increases throughout the drive portion of each stroke, as a function of the stretch in the cord. Both forms of opposition to rearward movement of the seat involve the muscles of the upper legs and hips, thereby enhancing the effectiveness of the exercise. In sum, the present invention provides a very simple, yet effective apparatus and method for exercising in a manner that simulates rowing. These and other advantages of the present invention will become apparent upon a more detailed description of the preferred embodiment.

DETAILED DESCRIPTION OF A PREFERRED EMBODIMENT

Figure 1:
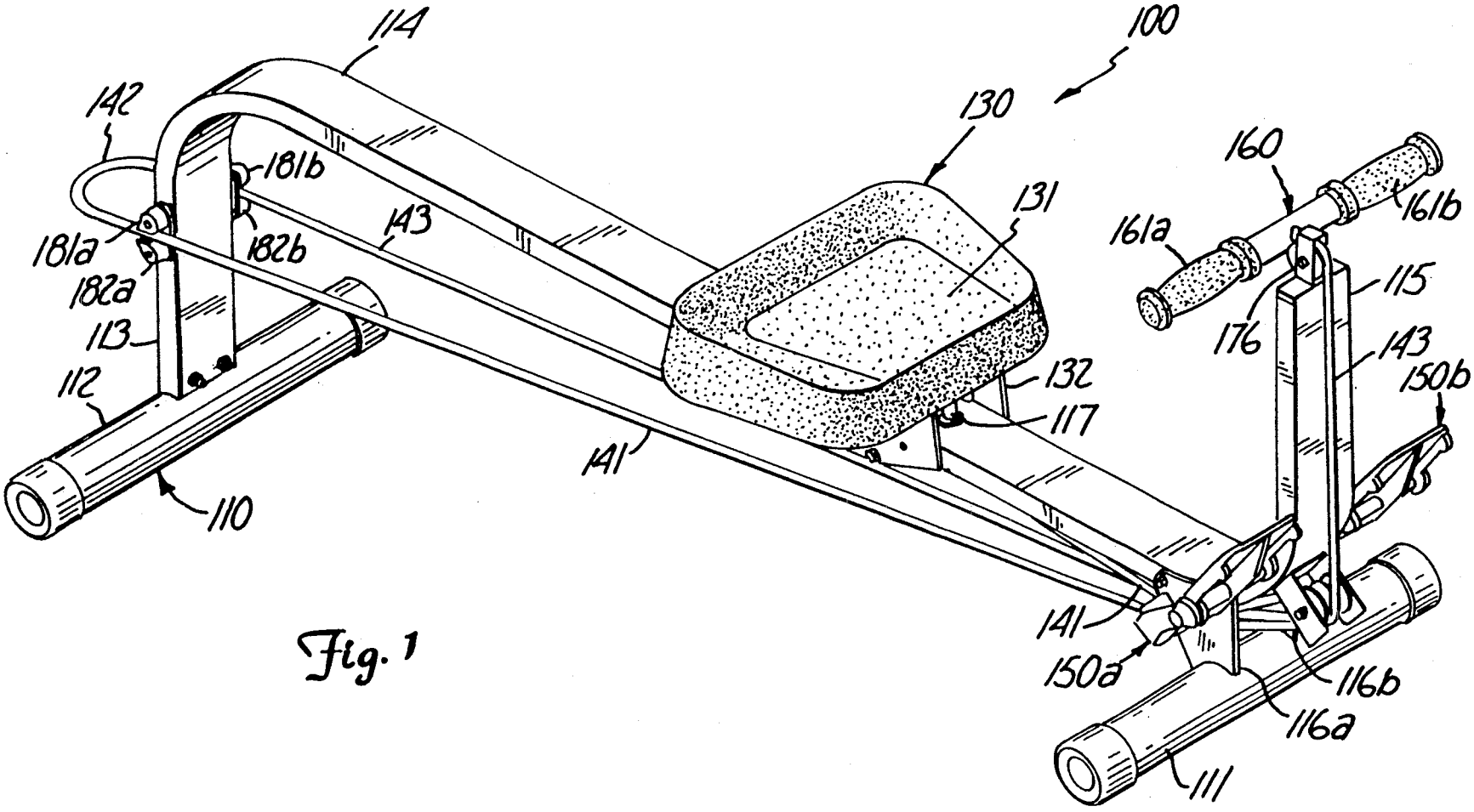
FIG. 1 is a perspective view of a preferred embodiment rowing machine exercise apparatus constructed according to the principles of the present invention.

With reference to the Figures, wherein like numerals represent like parts throughout the several views, a preferred embodiment rowing machine exercise apparatus constructed according to the principles of the present invention is designated as 100. As shown in FIG. 1, the apparatus 100 generally includes a frame 110, an inclined rail 114 supported by the frame 110, a seat 130 slidably secured relative to the rail 114, and a foot rest 150 mounted on the frame 110.

Figure 5:
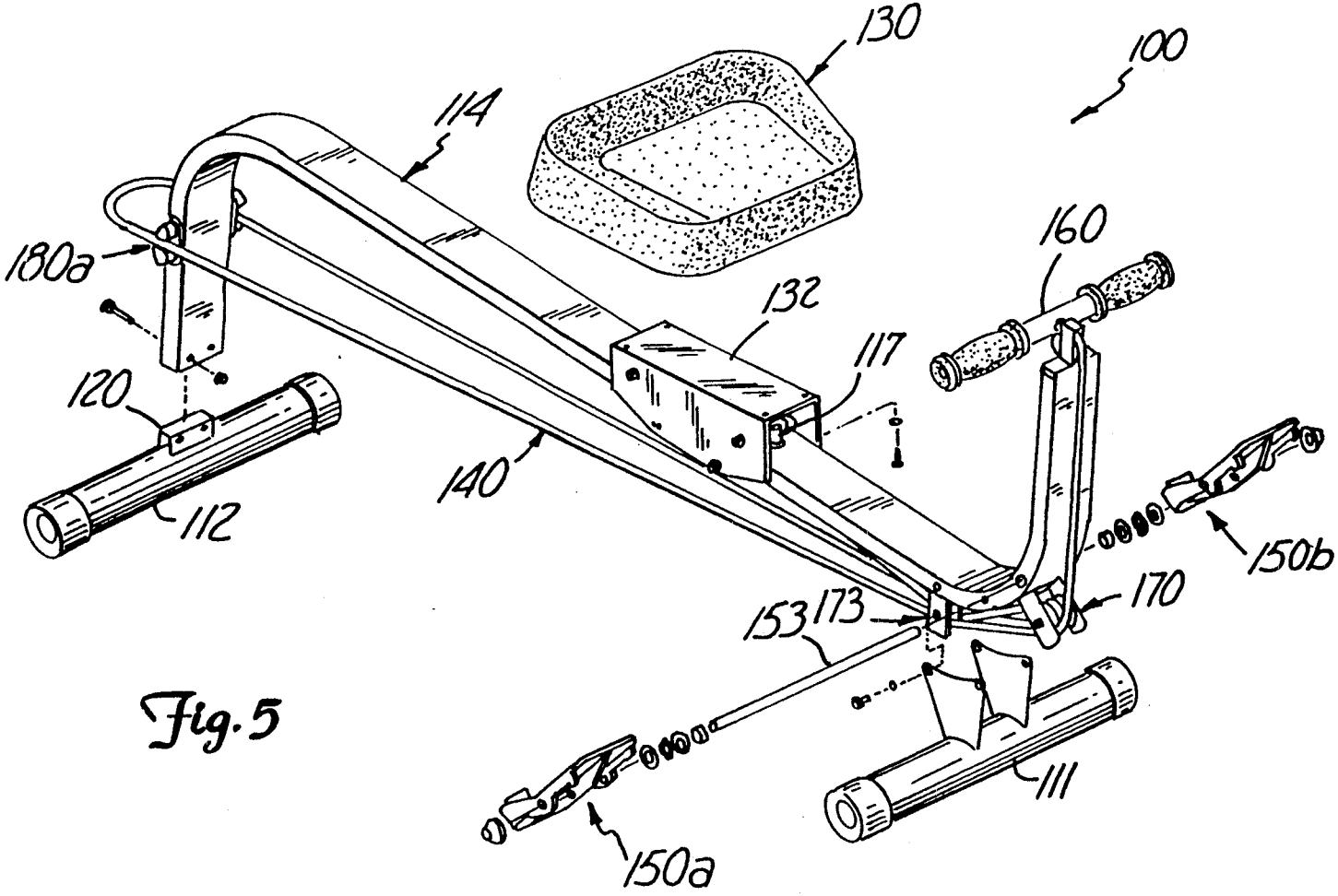
FIG. 5 is an exploded perspective view of the rowing machine exercise apparatus shown in FIG. 1.
Figure 7:
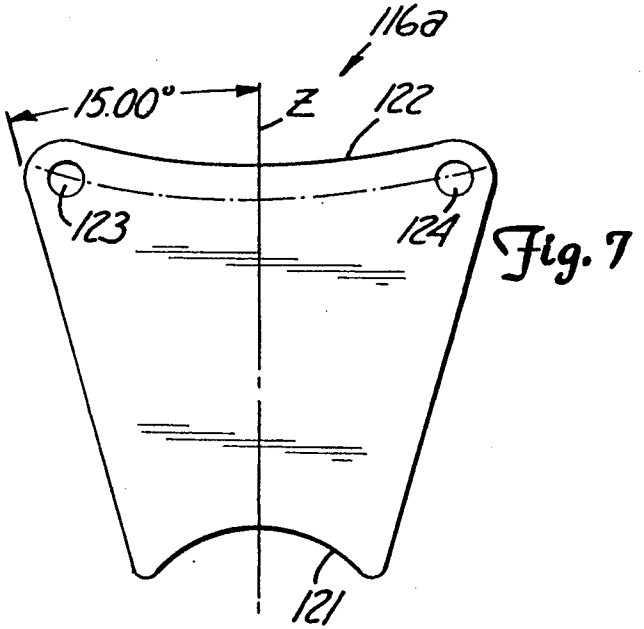
FIG. 7 is an enlarged side view of a support flange that is part of the rowing machine exercise apparatus shown in FIG. 1.

The frame 110 extends from a front end or first lateral support 111 to a rear end or second lateral support 112. As shown in FIG. 5, a tab 120 is mounted to the rear end 112 by welding, and a rear upright 113 is secured relative to the tab 120 by a nut and bolt combination. The rear upright 113 extends upward from the rear end 112 and is integrally joined to the rail 114. The rear upright 113 and the rail 114 define an angle of approximately ninety (90) degrees relative to one another. The rail 114 extends substantially linearly, but on a downward slope, to a front upright 115 that is integrally joined to the rail 114 and defines an angle of approximately ninety (90) degrees relative thereto. The front upright 115 extends upward to an elevation above the floor surface 99 higher than any portion of the rail 114. A frontward portion of the rail 114 is secured relative to the front end 111 by a pair of flanges **116*a* and 116*b*, one of which is shown in detail in FIG. 7**.

The flange **116*a*, which is identical to the flange 116*b*, is symmetrical about a center line Z. A lower concave edge 121 is designed to engage the cylindrical front support 111 and is secured thereto by welding. An upper end 122 of the flange 116*a* is configured to conform to the curved transition from the rail 114 to the front upright 115, which is shown in greater detail in FIG. 6. The upper end 122 is secured relative to the rail 114 by a nut and bolt combination, via holes 123 and 124** in the flange 116*a* and corresponding holes 125 and 126 in the frame 110.

Figure 2:
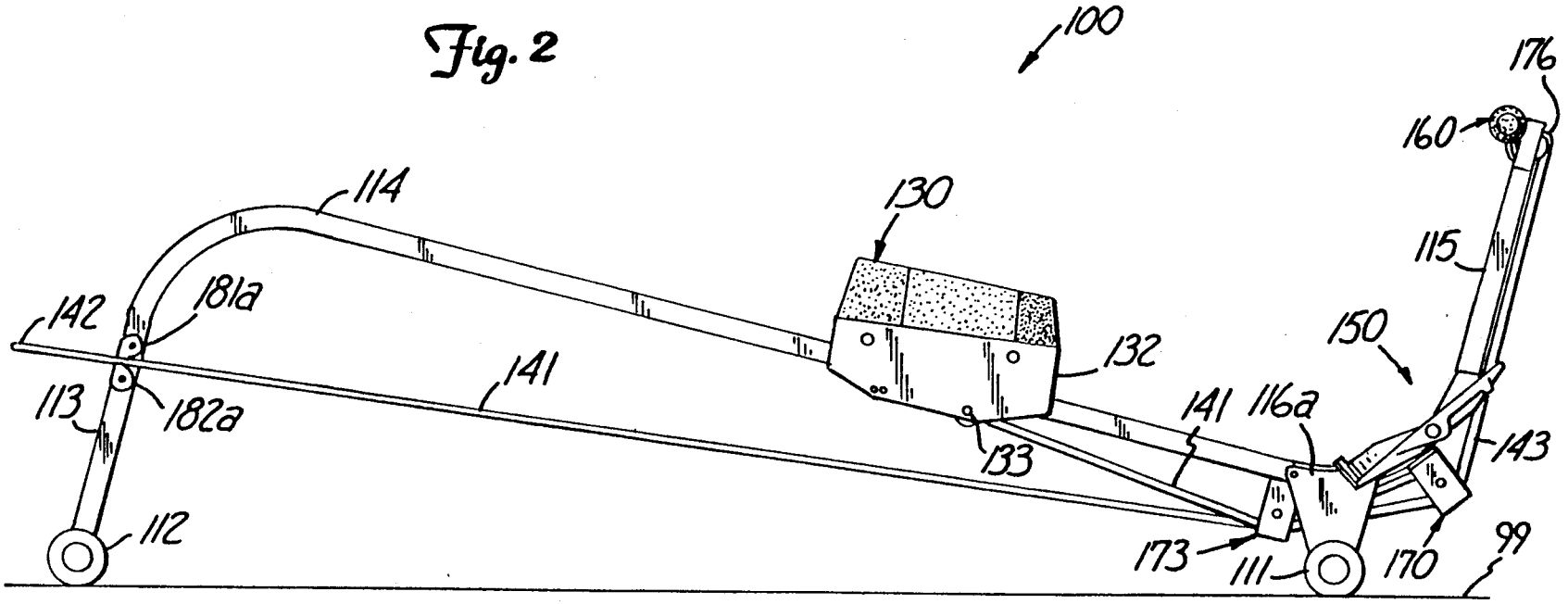
FIG. 2 is a side view of the rowing machine exercise apparatus shown in FIG. 1.
Figure 3:
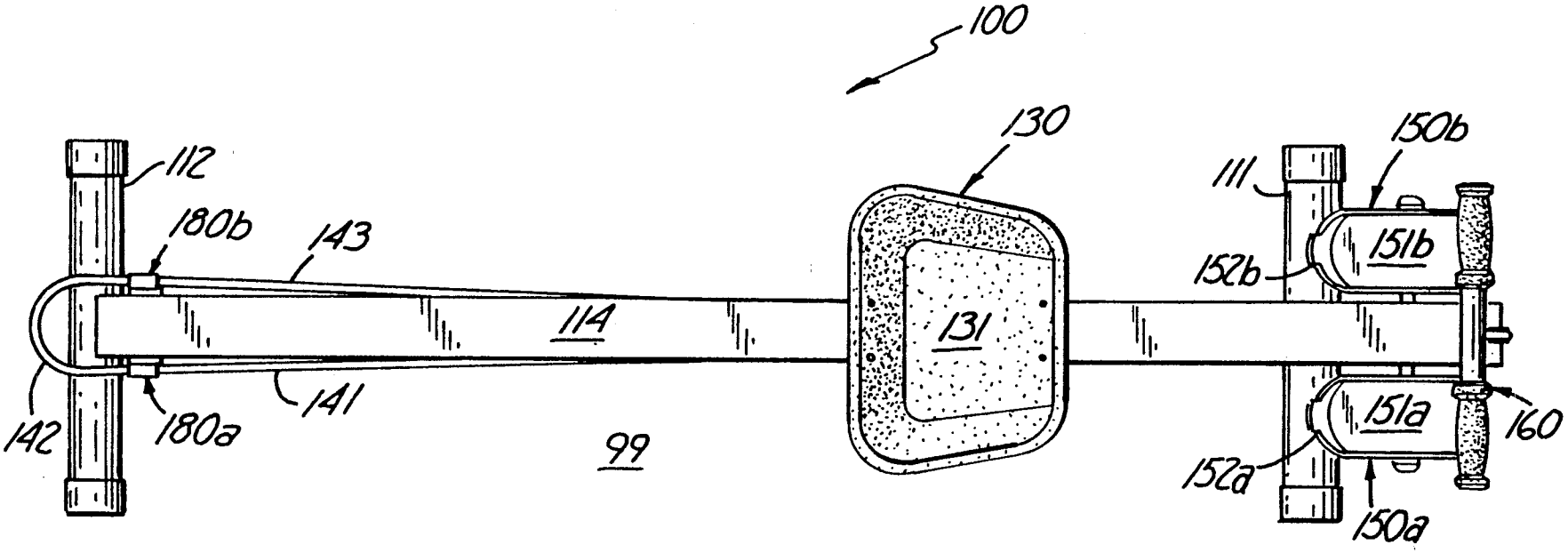
FIG. 3 is a top view of the rowing machine exercise apparatus shown in FIG. 1.

As shown in FIG. 2, the frame 110 as described above supports the rail 114 above the floor surface 99. In a preferred embodiment, the rail 114 is inclined downward from the rear end 112 to the front end 111, defining an angle of approximately fourteen (14) degrees relative to the floor surface 99. However, those skilled in the art will recognize that the rail inclination may vary significantly without departing from the scope of the present invention.

The seat 130 is mounted to a carriage 132, which in turn is movably secured relative to the inclined rail 114. The carriage 132 engages the rail 114 by means of rollers that are rotatably mounted on the carriage 132. The rollers roll on the rail 114 and have external flanges that keep the carriage 132 linearly aligned on the rail 114. As a result of gravitational forces, the inclination of the rail 114 biases the seat 130 in the forward direction, or alternatively, opposes rearward movement of the seat 130. The seat 130 includes a surface 131 on which a person may comfortably sit. Due to the inclination of the rail 114, the surface 131 is necessarily a significant distance above the floor surface 99, making the apparatus 100 relatively safe and easy to mount and dismount.

A stop 117 inserts into a hole in the rail 114 and extends upward from the rail 114 in front of the carriage 132 to prevent the carriage 132 from moving forward beyond the stop 117. The stop 117 may be removed from the hole in the rail 114 to no longer impede forward travel of the seat 130 relative to the rail 114. The stop 117 provides a safety feature, especially for persons undergoing rehabilitation or susceptible to back injury, where only a limited range of motion is desired. A series of holes may be formed in the rail 114 to provide alternative ranges of motion.

The foot rest 150 includes right and left foot supports 150*a* and 150*b*, respectively, which are pivotally mounted on a common shaft 153 relative to the frame 110. The foot rest 150 is anchored to the frame along the transitional curve between the rail 114 and the front upright 115, just beneath the latter. Each of the foot supports 150*a* and 150*b* includes a platform 151*a* and 151*b* against which a person may press his or her feet, and a heel rest 152*a* and 152*b* against which a person may rest his or her heels. A person sitting on the may press his or her feet against the foot supports 150*a* and 150*b* to force the and the carriage 132 backward along the rail 114. As a result of the inclined rail, the foot rest 150 is positioned at a lower elevation above the floor surface than any effective portion of the rail 114. Thus, the feet of a person sitting in the will be below the person's hips, which is a relatively more comfortable position and encourages better posture. The "semi-recumbent" rowing motion requires relatively more leg work and involves more muscles of the hip and upper thigh than do "flat" rowing machines. The reduction in lower back fatigue associated with "recumbent" rowing, as well as the increase in leg exercise, improves the aerobic benefits of a rowing workout.

To the extent that gravitational force provides resistance to backward movement, the inclined rail's "built-in" resistance to rearward movement of the seat 130 is a function of a person's weight. The relative steep inclination of the rail 114 provides an additional benefit by reducing stress on the person's back because even in a fully laid back position, the person is not approaching a position parallel to the floor surface 99, where maximum strain on the back occurs as a person attempts to right himself or herself. The inclined rail 114 also encourages proper posture throughout the rowing motion.

Additional resistance to rearward movement of the seat 130 is provided by load resistant line means 140, which takes the form of a segment of bungee cord 141 in the preferred embodiment. Those skilled in the art will recognize that other forms of load resistant line means may be used without departing from the scope of the present invention. The cord 141 is operatively connected to the seat 130 and the frame 110 so as to oppose rearward movement of the seat 130 along the rail 114. Together with the "built-in" weight resistance, the bungee cord provides smooth resistance to rearward movement of the seat 130, that more subtly increases over the length of the drive portion of the stroke. Both types of resistance are essentially silent in operation.

Figure 4:
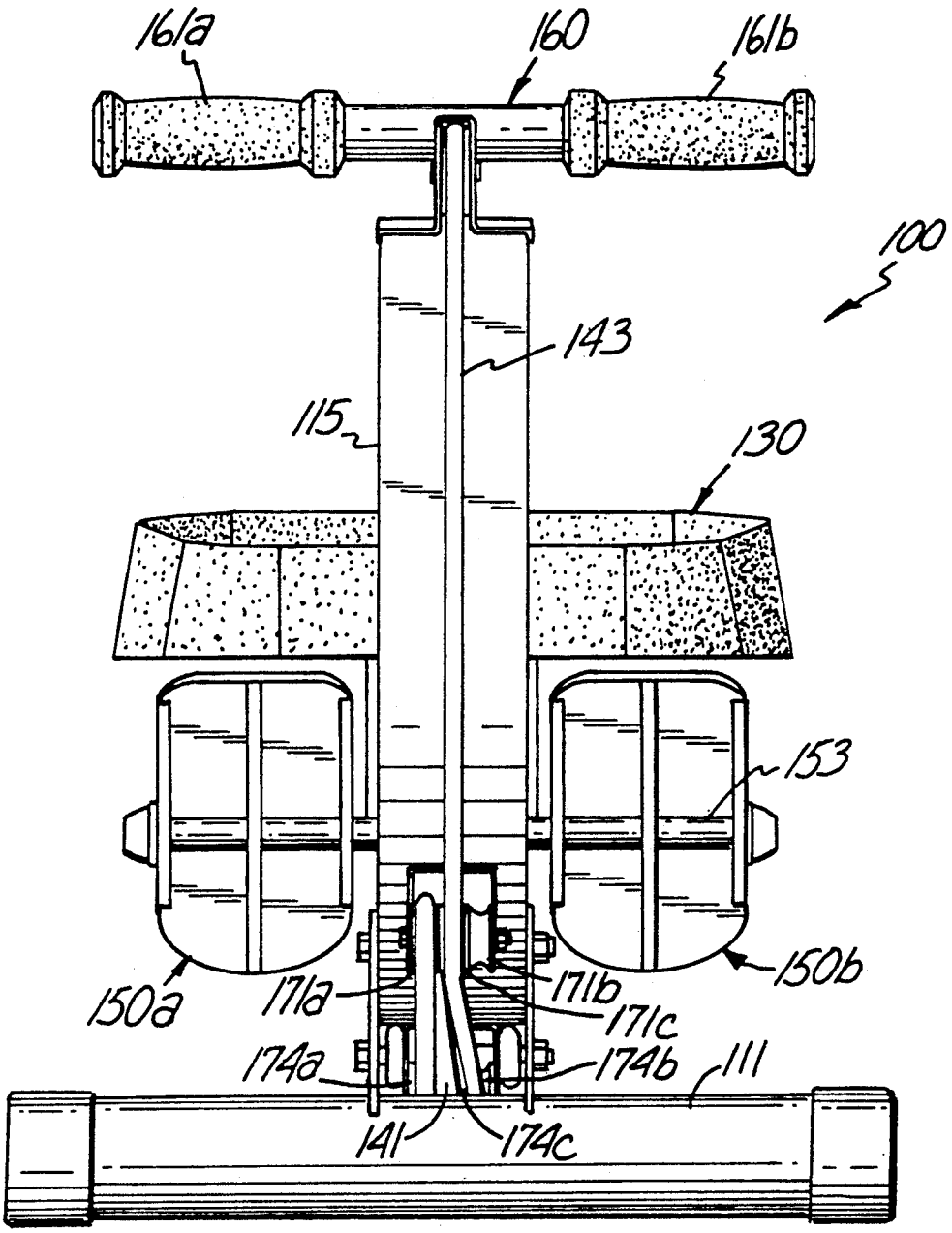
FIG. 4 is a front view of the rowing machine exercise apparatus shown in FIG. 1.
Figure 9:
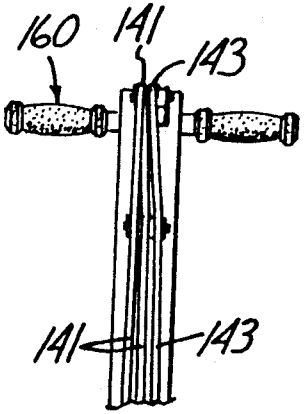
FIG. 9 is an enlarged bottom view of a portion of the rowing machine exercise apparatus shown in FIG. 1.

A first end of the elastic cord 141 is secured to the seat 130, and the cord 141 extends forward from the seat 130 toward a pulley assembly 173, which is mounted on the frame 110 intermediate the stop 117 and the front end 111. The cord 141 engages a lower portion of a center pulley 174*c* on the intermediate pulley assembly 173 and continues forward toward another pulley assembly 170 mounted on the frame 110 proximate the front end 111. The cord 141 passes around a right pulley 171*a* on the forward pulley assembly 170 and extends backward toward the intermediate pulley assembly 173. The cord 141 engages a lower portion of a right pulley 174*a* on the intermediate pulley assembly 173 and continues backward toward the rear end 112 of the frame 110. The routing of the cord 141 relative to the pulley assemblies 170 and 173 can perhaps best be seen by reference to FIGS. 4 and 9, which illustrate the apparatus 100 as seen from the front and bottom, respectively. A second effective end of the cord 141 is secured relative to the frame 110 by a first retaining means 180*a* in the form of a nip arrangement mounted proximate the rear end 112 of the frame 110. Those skilled in the art will recognize that other types of retaining means may be used without departing from the scope of the present invention.

Figure 8:
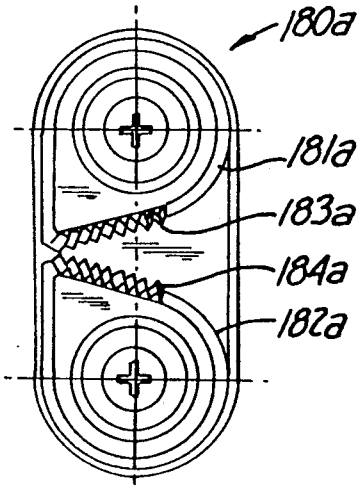
FIG. 8 is an enlarged side view of a nip arrangement that is part of the rowing machine exercise apparatus shown in FIG. 1.

As shown in greater detail in FIG. 8, the first nip arrangement 180*a* includes opposing cam members 181*a* and 182*a* having jagged cord engaging surfaces 183*a* and 184*a*, respectively. The cord 141 passes between the cam members 181*a* and 182*a*, and tension in the cord 141 causes the surfaces 183*a* and 184*a* to engage or "bite" the cord 141 in such a manner that the cord 141 may be pulled rearward through the first nip arrangement 180*a*, but the cord 141 is restrained against forward movement relative to the surfaces 183*a* and 184*a*.

The resistance provided by the load resistant line means 141 is a function of the tension in the cord 141. In this regard, the resistance can be increased by pulling some additional portion of the cord 141 rearward through the first nip arrangement 180*a*. Similarly, the resistance can be decreased by increasing the length of the cord 141 anchored between the seat 130 and the first nip arrangement 180*a*. The tension in the cord 141 is decreased by pulling the cord 141 laterally out of engagement with the first nip arrangement 180*a* and reintroducing the cord 141 into engagement with the first nip arrangement 180*a* at a greater effective length.

A hand bar 160 is connected to a second load resistant line means or elastic cord 143. Tension in the cord 143 maintains the hand bar 160 in contact with an elevated pulley 176 mounted on top of the front upright 115. The bar 160 is higher above the floor surface 99 than any portion of the rail 114. The bar 160 extends perpendicular relative to the rail 114 and parallel relative to the floor surface 99. The relative high location of the bar 160 reduces the need to lean forward during the recovery portion of the stroke, further safeguarding against possible injury to the lower back. The bar 160 may be said to be "retractable" in the sense that the bar 160 is free to be pulled rearward from the front upright 115; subject only to any resistance from the cord 143. The cord 143 extends from the retractable bar 160 over the elevated pulley 176 and downward toward the forward pulley assembly 170. The cord 143 passes around a center pulley 171*c* on the forward pulley assembly 170 and backward and downward toward the intermediate pulley assembly 173.

Figure 6:
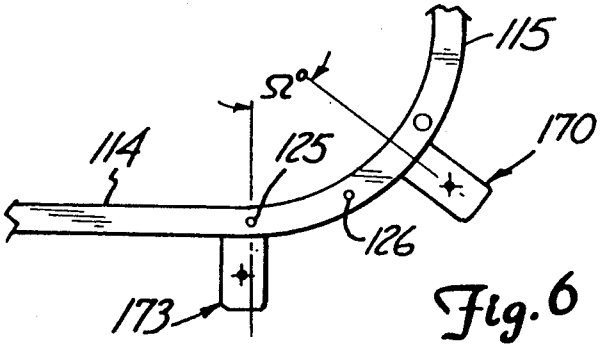
FIG. 6 is an enlarged side view of a portion of the frame that is part of the rowing machine exercise apparatus shown in FIG. 1.

In order to minimize the potential for injury and maximize efficient use of space, the pulley assemblies 170 and 173 guide the cords 141 and 143 along the surface of the frame 110 that is opposite the side on which the seat 130 travels. As can be seen in FIG. 6, in circumventing the curved contour of the frame 110, the cord 143 is deflected by the forward pulley assembly 170 approximately sixty (60) degrees relative to the front upright 115, and the cord 143 is deflected by the pulley assembly 173 approximately an additional twenty-five (25) degrees. The pulleys are aligned with their axes perpendicular to the longitudinal axis of the rail 114.

Beyond the forward pulley assembly 170, the cord 143 engages a left pulley 174*b* on the intermediate pulley assembly 173 and continues backward toward the rear end 112 of the frame 110. A second effective end of the cord 143 is secured relative to the frame 110 by a second retaining means or nip arrangement 180*b* mounted proximate the rear end 112 of the frame 110. The second nip arrangement 180*b* operates in the same manner as the first nip arrangement 180*a* discussed above and shown in detail in FIG. 8. As perhaps best shown in FIG. 1, in the preferred embodiment, the cords 141 and 143 are integral portions of a single elastic cord 140. Thus, the cords 141 and 143 share a common slack portion 142 that is caught between the first and second nip arrangements 180*a* and 180*b*, respectively. The overall length of the elastic cord 140 is such that some slack portion 142 exists even when the cords 141 and 143 are at zero tension.

In operation, the single load resistant line means 140 is used to provide dual resistance to exercise on the rowing simulator 100. A first end of the elastic cord 140 is secured to the simulator rowing bar 160, and a first intermediate portion 143 of the elastic cord 140 is routed over at least two pulleys 176 and 171*c* and through a nip arrangement (in this case 180*b*). As a result, a first intermediate length 143 of the elastic cord 140 is anchored between the simulator rowing bar 160 and the nip arrangement 180*b*. A second intermediate portion 141 of the elastic cord 140 is routed through another nip arrangement (in this case 180*a*) and over at least one pulley 171*a*, thereby defining a slack portion 142 of the elastic cord 140 between the nip arrangements. The second intermediate portion 141 terminates in a second end of the elastic cord 140, which is secured to the seat 130, thereby anchoring a second intermediate length 141 of the elastic cord 140 between the other nip arrangement 180*a* and the seat 130. The first and second intermediate lengths 143 and 141 of the elastic cord 140 can be independently adjusted in a manner already described above in order to vary the resistance to movement of the hand bar 160 and the seat 130, respectively. Those skilled in the art will recognize that the apparatus 100 utilizes a simple and efficient design to provide a safe and effective rowing workout. Also, the apparatus 100 decreases the chances of back injury, while increasing the rewards that can be realized from a rowing workout. Furthermore, the apparatus 100 is relatively lightweight and portable, and virtually noiseless in operation.

In addition to obvious design choices, a range of improvements may be incorporated into the preferred embodiment. For example, the inclination of the rail could be made adjustable by lengthening the tab 120 and providing a series of holes through which the rear upright 113 may be secured to the rear end 112. Also, the rest position of the hand bar 160 could be made adjustable in terms of both elevation and longitudinal position relative to the rail. Further, a calibration system could be imposed on the load resistance line means 140 to help assure consistency and document improvement between workouts. An additional source of motivation could be provided in the form of electronics that measure and display performance parameters. The device for measuring performance data could be incorporated into the cords, the bar, and/or the rail.

The present invention has been described with reference to a preferred embodiment. However, those skilled in the art will recognize a variety of alternative embodiments that fall within the scope of the present invention. Accordingly, the present invention is to be limited only by the appended claims.

We claim:

1. A method of providing resistance to exercise movement on a rowing simulator using a single elastic cord, comprising the steps of:

securing a first end of the elastic cord to a simulator rowing bar;

routing a first intermediate portion of the elastic cord over at least two pulleys and through a first nip arrangement, thereby anchoring a first intermediate length of the elastic cord between the simulator rowing bar and the first nip arrangement;

routing a second intermediate portion of the elastic cord through a second nip arrangement and over at least one pulley, wherein a slack portion of the elastic cord is defined between the first nip arrangement and the second nip arrangement, and the second intermediate portion terminates in a second end of the elastic cord; and securing the second end of the elastic cord to a seat, thereby anchoring a second intermediate length of the elastic cord between the second nip arrangement and the seat.

2. A method according to claim 1, further comprising the step of adjusting the first intermediate length of elastic cord anchored between the simulator rowing bar and the first nip arrangement.

3. A method according to claim 1, further comprising the step of adjusting the second intermediate length of elastic cord anchored between the second nip arrangement and the seat.

4. An exercise apparatus, comprising:

a frame having a front end and a rear end, and designed to rest upon a floor surface;

an inclined rail supported above the floor surface by said frame, wherein said inclined rail defines an angle of greater than five degrees relative to the floor surface;

a seat slidably secured relative to said rail, wherein the angle of said rail opposes rearward movement of said seat;

a load resistant line means secured at one end to said seat and secured at another effective end to said frame wherein said load resistant line means opposes rearward movement of said seat;

a retractable hand bar positioned proximate said front end of said frame; and a second load resistant line means secured at one end to said hand bar secured at another effective end to said frame, wherein said second load resistant line means opposes rearward movement of said hand bar;

wherein said load resistant line means and said second load resistant line means are integral portions of a single elastic cord.

* * * * *